US005772121A

United States Patent [19]

Wang

[11] Patent Number: 5,772,121

[45] Date of Patent: Jun. 30, 1998

[54] SPRINKLER HEAD FOR A SPRINKLER MOUNTED TO A GARDEN HOSE

[75] Inventor: King-Yuan Wang, Changhua Hsien, Taiwan

[73] Assignee: Yuan Mei Corp., Changhua Hsien, Taiwan

[21] Appl. No.: 910,397

[22] Filed: Aug. 13, 1997

[51] Int. Cl.[6] ..... B05B 7/02

[52] U.S. Cl. ..... 239/394; 239/394; 239/436; 239/437; 239/440; 239/525; 239/526

[58] Field of Search ..... 239/394, 436, 239/437, 440, 444, 447, 548, 552, 525, 526

[56] References Cited

U.S. PATENT DOCUMENTS

| | | | |
|---|---|---|---|
| 4,666,085 | 5/1987 | Liaw | 239/394 |
| 4,903,897 | 2/1990 | Hayes | 239/394 |
| 5,232,162 | 8/1993 | Chih | 239/394 |
| 5,348,228 | 9/1994 | Wang | 239/394 |
| 5,501,400 | 3/1996 | Kuo | 239/394 |

*Primary Examiner*—Lesley D. Morris
*Assistant Examiner*—David Deal
*Attorney, Agent, or Firm*—Browdy and Neimark

[57] ABSTRACT

An improved sprinkler head for use on a sprinkler gun in connection to garden hose having a sprinkling cap, a bottom board and a base is removably secured to a sprinkler gun. The bottom board having a number of holes defined on the periphery of a circle is secured to the sprinkling cap by ultrasonic welding art. The sprinkling cap has a number of discharge openings defined in correspondence to the holes of the bottom board. The base having a discharge outlet, and the sprinkling cap along with the bottom board are fixed together by a screw. The discharge openings of the sprinkling cap have a tubular extension respectively and the extensions are bridged by a continual wall so as to define a closed area. A ring area having a plurality of tiny pores disposed adjacent the circularly located discharge openings corresponds to the outer side of the wall-closed area and a small ring of tiny pores disposed at the center of the sprinkling cap corresponds to the inner side of the wall-closed area so that when the sprinkling cap is selectively rotated to make the discharge outlet register with one of the discharge openings of the sprinkling cap water can be delivered in different manners.

3 Claims, 6 Drawing Sheets

SPRINKLER HEAD FOR A SPRINKLER MOUNTED TO A GARDEN HOSE

BACKGROUND OF THE INVENTION

The present invention relates to an improved sprinkler head for use on a sprinkler in connection to a garden hose. The sprinkler head made up of a sprinkling cap, a bottom board and a base is removably secured to a sprinkler gun. The bottom board having a number of holes defined on the periphery of a circle is secured to the sprinkling cap by ultrasonic welding art. The sprinkling cap has a number of discharge openings defined in correspondence to the holes of the bottom board. The base having a discharge outlet, and the sprinkling cap along with the bottom board are fixed together by a screw. The discharge openings of the sprinkling cap have a tubular extension respectively and the extensions are bridged by a continual wall so as to define a closed area. A ring area having a plurality of tiny pores disposed adjacent the circularly located discharge openings corresponds to the outer side of the wall-closed area and a small ring having tiny pores disposed at the center of the sprinkling cap corresponds to the inner side of the wall-closed area so that when the sprinkling cap is selectively rotated to make the discharge outlet register with one of the discharge openings of the sprinkling cap water can be delivered in different manners.

There are many types of sprinkler guns equipped with different sprinkler heads available on commercial markets. They are commonly structured in a complex manner and produced at high costs. However, even water can be discharged via such sprinkler heads in many various ways, the intensity and quality of such discharges are not so satisfactory in practical use.

SUMMARY OF THE INVENTION

Therefore, the primary object of the present invention is to provide an improved sprinkler head for use in a garden hose, having a simplified strucutre but still permiting water to be discharged in many various manners.

Another object of the present invention is to provide an improved sprinkler head which is provided with a sprinkling cap having a number of tubular extensions on one side thereof that are bridged by a continual wall so as to form a wall-closed area. A ring area having a plurality of tiny pores corresponds to the outer side of the wall-closed area and a small ring of tiny pores corresponds to the inner side of the wall-closed area; or a discharge opening communicates with the inner side of the wall-closed area so that water can be first led into the wall-closed area and then discharged with force via one discharge opening.

BRIEF DESCRIPTION OF THE PREFERRED EMBODIMENTS

DETAILED DESCRIPTION OF THE PREFERRED EMBODIMENTS

Figure 1:
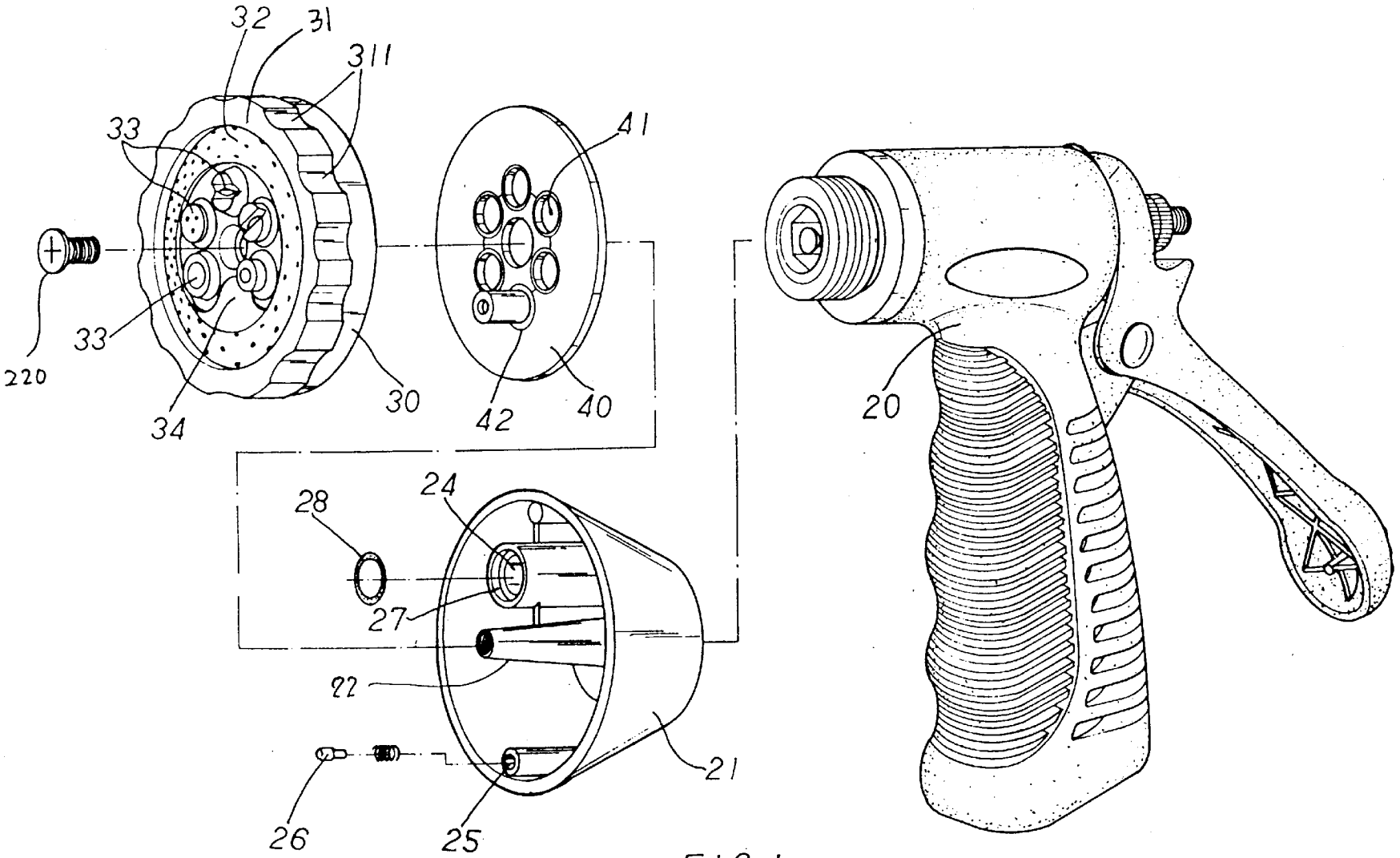
FIG. 1 is a diagram showing the exploded components of the present invention.

Referring to FIG. 1, the sprinkler head of the present invention is mounted to a conventional sprinkler gun 20. The sprinkler head has a base 21 of a flat-ended cone shape to which a multi-outlet sprinkling cap 30 along with a bottom board 40 is secured. The sprinkling cap 30 and the bottom board 40 are bound together by ultrasonic welding art.

The cone-shaped base 21 has a central mounting pole 22 which is guided through the central hole 310 of the sprinkling cap 30 so as to permit the base 21 and the sprinkling cap 30 along with the bottom board 40 to be fixed together by a screw 220 to form a sprinkler head. The base 21 also has a discharge outlet 24 disposed internally next to the mounting pole 22 and a retaining seat 25 in which a spring actuated retaining pin 26 is housed is defined near the circular rim of the base 21. The discharge outlet 24, the mounting pole 22 and the retaining seat 25 are located linearly along the central line thereof. The discharge outlet 24 is provided with a counter-sink 27 so as to permit a O shaped ring 28 to be housed therein. The base 21 has a central cavity 23 provided with inner threads so as to permit the base 21 to be removably secured to the sprinkler gun 20 in assembly.

The sprinkling cap 30 having a central mounting hole 300 for the location of the screw 220 has a peripheral rim 31 having alternative smooth recesses 311 for easy rotation thereof; and a ring area 32 defined next to the rim 31 has a plurality of tiny pores. Inside the ring area 32 and at the center of the sprinkler head 30 are defined a number of discharge openings 33 of different shape and a closed area 34 that are disposed peripherally.

Figure 2:
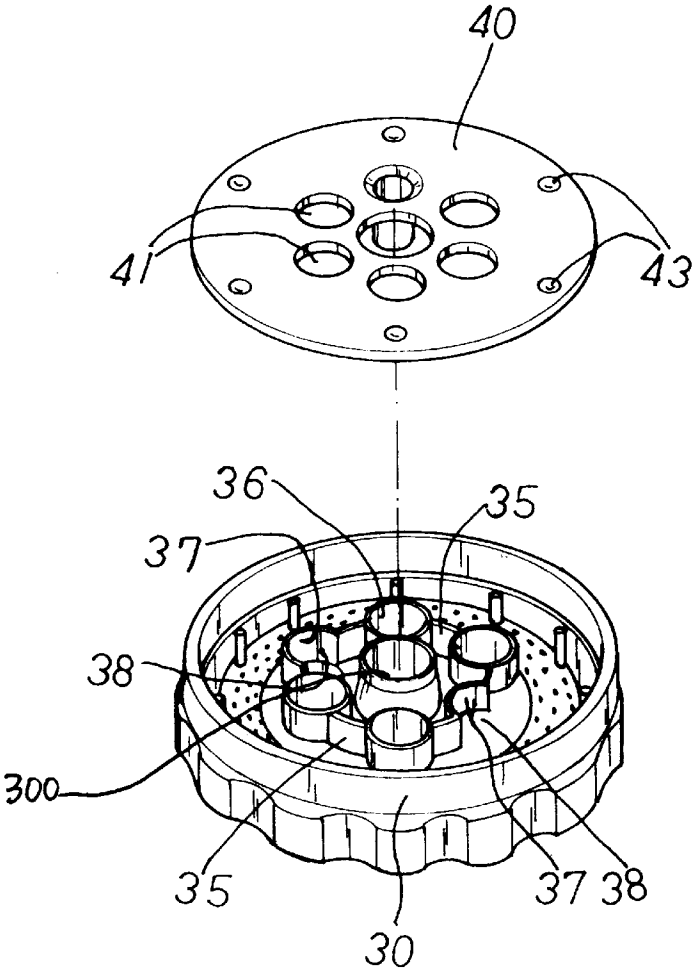
FIG. 2 is a diagram showing the detailed structure of the sprinkling cap and the bottom board.

As shown in FIG. 2, the reverse side of the sprinkler head including the sprinkling cap 30 and the bottom board 40 is illustrated for easy understanding of the structure thereof. The discharge openings 33 are all provided with a tubular extension 36 on the other side of the sprinkling cap 30. The tubular extensions 36 are bridged together by continual vertical walls 35 so as to define, in correspondence to the ring area 32, a closed area outside the walls 35.

Among the tubular extensions 36 there are two opposite ones are defined in a half tube 37 with the cut 38 facing toward the inner side and outer side of the continually walled area respectively. The closed area 34 matches with the half tube 37 with the cut 38 facing toward the outer side of the walled area so as to permit water to be led into the ring area 32 and discharged out thereof via the plurality of the tiny pores. The other half tube 37 facing the inner side of the continually walled area is used to collect water in the closed area before being discharged via the discharge opeing 33 so as to make the discharge stream in a stronger manner.

Figure 3:
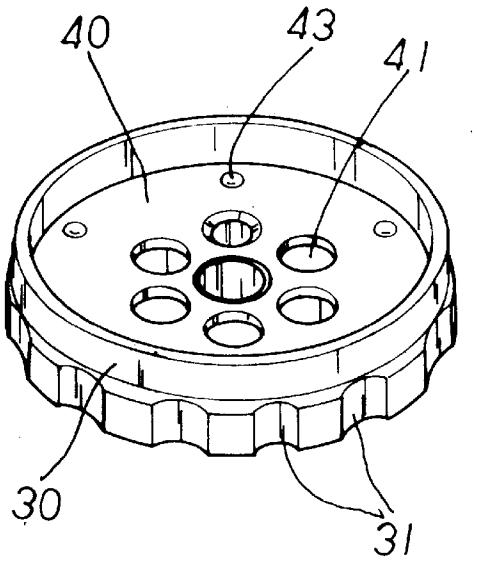
FIG. 3 is a diagram showing the assembly of the sprinkling cap and the bottom board.

The bottom board 40 has 6 round holes 41 disposed in correspondence to the 6 discharge openings 33 of the sprinkling cap 30. The tubular extensions 36 of the discharge openings 33 are registered with the corresponding round holes 41 of the bottom board 40. Each round hole 41 is provided with a welding rim protrusion 42 so as to permit the sprinkling cap 30 and the bottom board 40 to be sealedly engaged with each other by ultrasonic welding art, as shown in FIG. 3.

Figure 4:
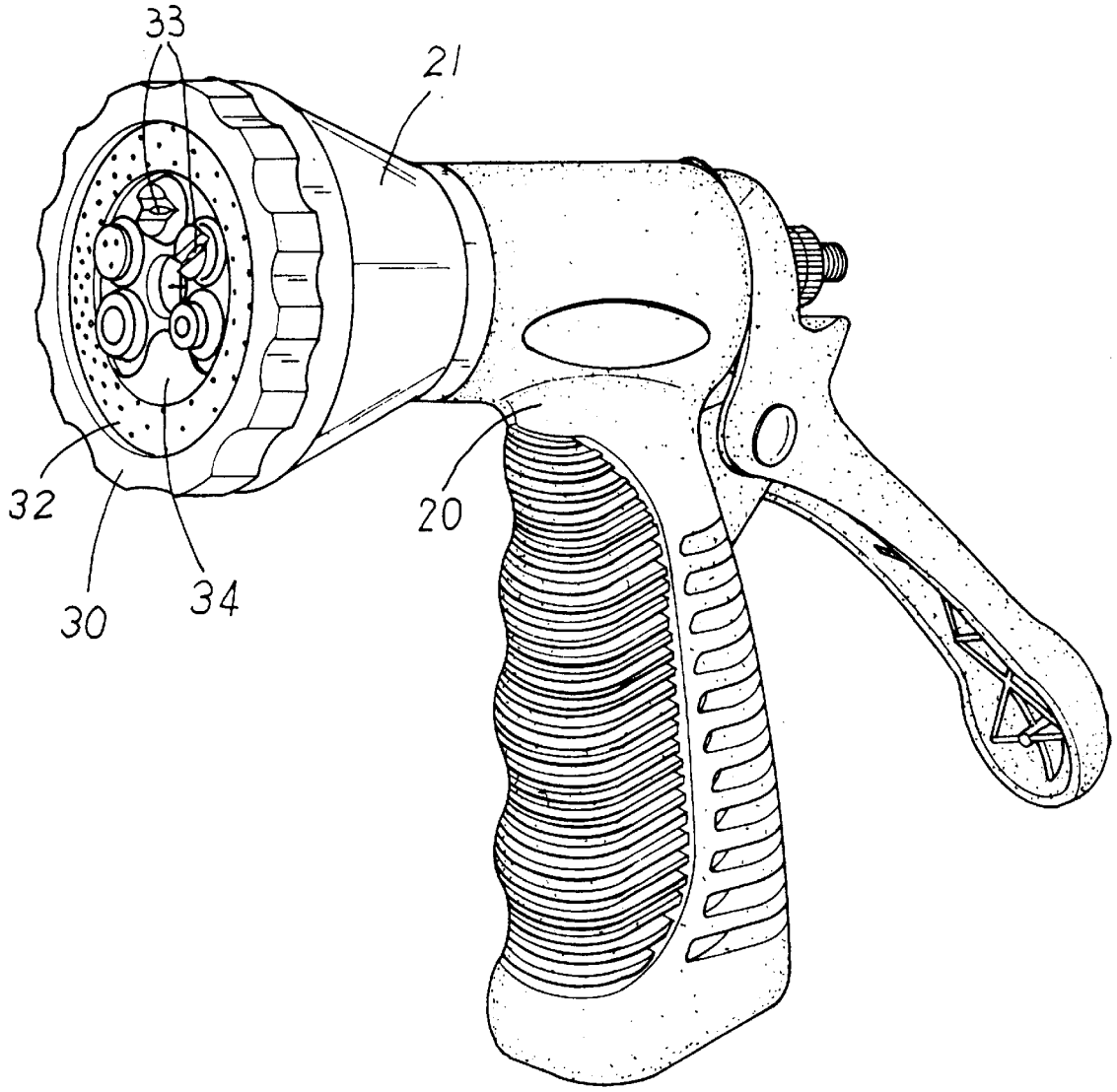
FIG. 4 is a diagram showing the sprinkler gun of the present invention.

Referring to FIG. 4, the sprinkler head of the present invention is mounted to the sprinkler gun 20 to complete the assembly.

As further shown in FIG. 2, the outer side of the bottom board 40 is provided with a number of spaced positioning cavities 43 on the periphery thereof and the spring biased retaining pin 26 is selectively engaged with one of the positioning cavities 43 when the sprinkler head and the sprinkler gun 20 is assembled. The engagement of the retaining pin 26 and the positioning cavities 43 assures of the precise registration of the discharge outlet 24 of the base 21 with one of the selected round holes 41 of the bottom board 40 in each rotation of the sprinkler head. The sealing ring 28 is used to effect sealing of the discharge outlet 24 so as to make water to be discharged out of one selected discharge opeinging 33.

Figure 6C:
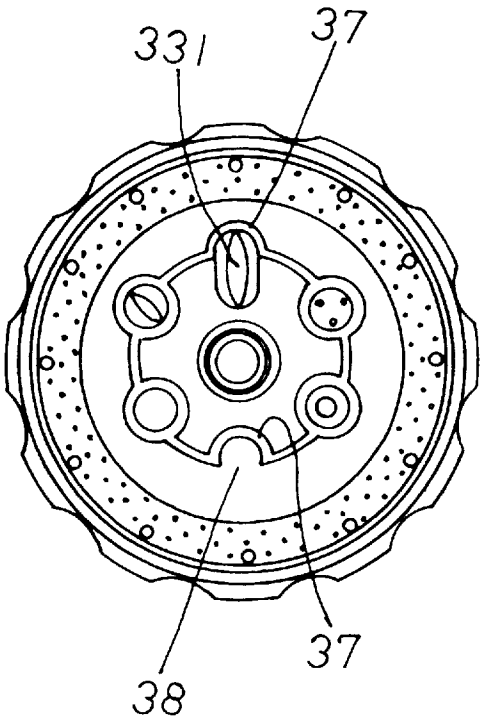
FIGS. 6A, 6B, 6C are diagrams showing how water is discharged in another operation mode.
Figure 6B:
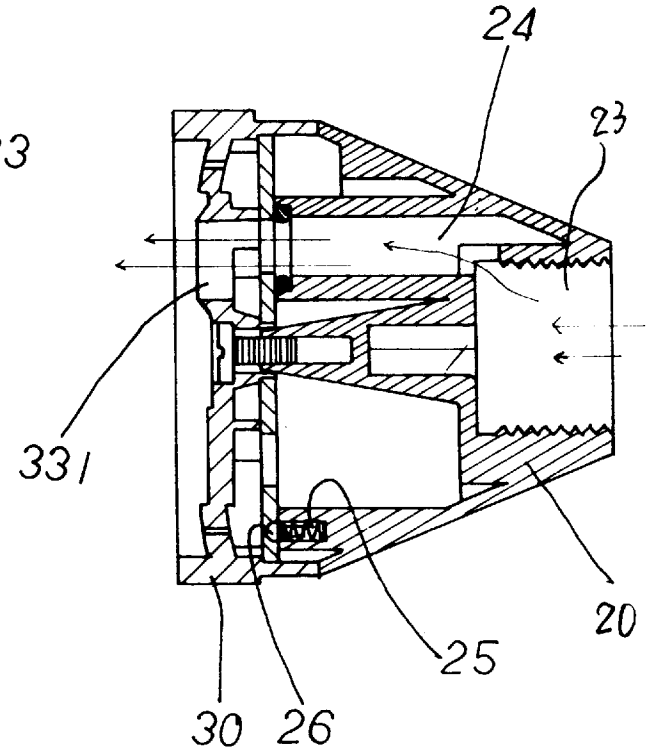
Figure 6A:
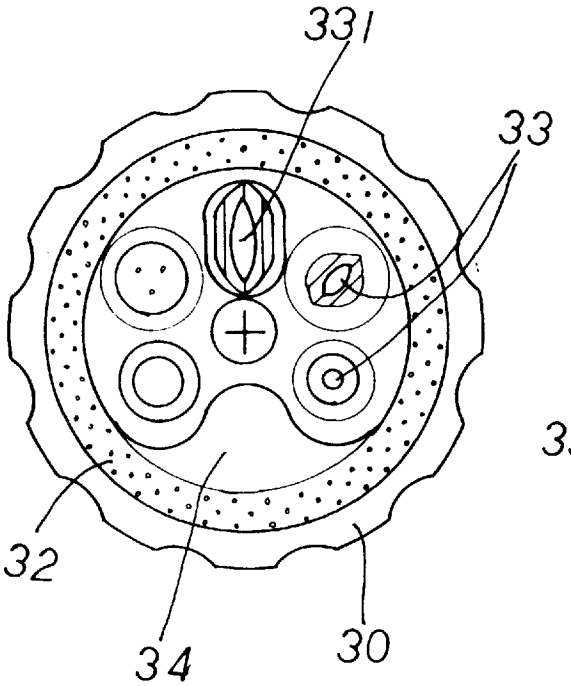
Figure 5A:
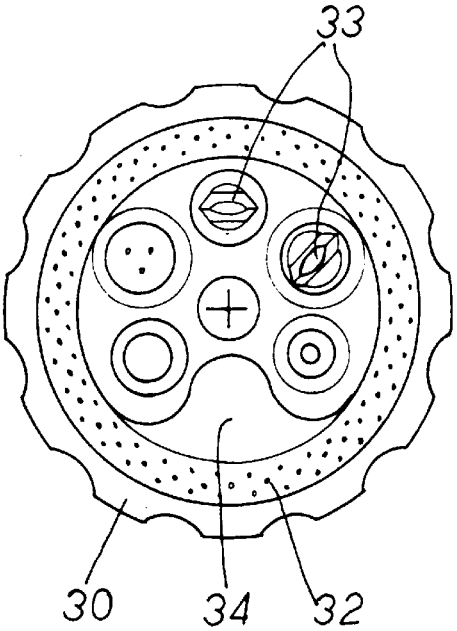
FIGS. 5A, 5B are diagrams showing how water is delivered and discharged from one of the selected discharge openings.
Figure 5B:
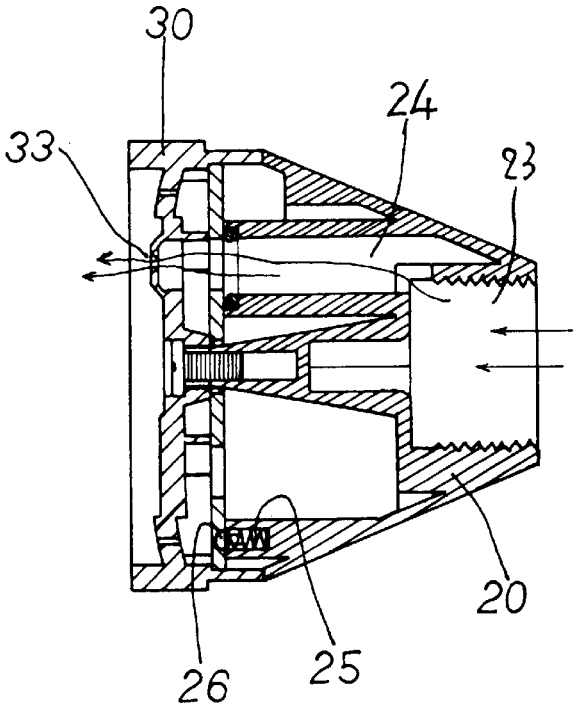

Referring to FIGS. 5A, 5B, water can be discharged via the general discharge openings 33 when the discharge outlet 24 of the base 21 comes into registration with the discharge openings 33 selectively. In FIGS. 6A, 6B, 6C, another modification of the present invention is given wherein one of the discharge opening 33 is converted into a narrower opening 331 having a vertical instead of horizontal orientation. The tubular extension corresponding to the opening 331 is formed in a half tube 37 having a cut 38 in such a manner that the cut 38 faces the inner side of the wall-closed area with the opening 331 located inside the area so that water can be led into the wall-closed area and discharged in a stronger intensity when the discharge outlet 24 comes in registration with the half tube 37 of the sprinkling cap 30.

Figure 7A:
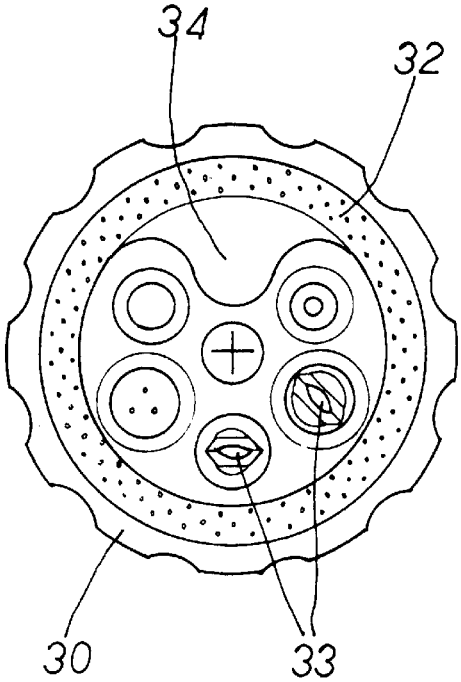
FIGS. 7A, 7B are diagrams showing how water is delivered and discharged from a ring area having a plurality of tiny pores.
Figure 7B:
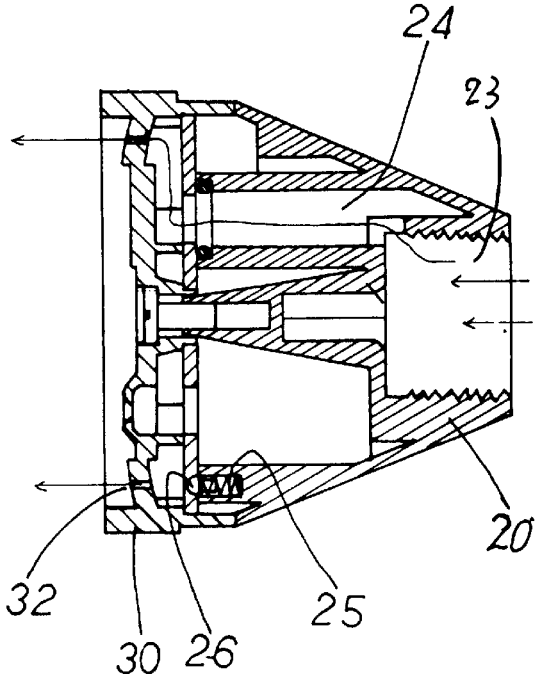

Referring further to FIG. 7A, 7B, the diagrams shows how water is discharged via the ring area 32 having a plurality of tiny pores when the closed area 34 of the sprinkling cap 30 comes into registration with the discharge outlet 24 with the cut 38 of the half tube 37 facing outside of the wall-closed area so as to permit water to be guided into the ring area 32.

Figure 8C:
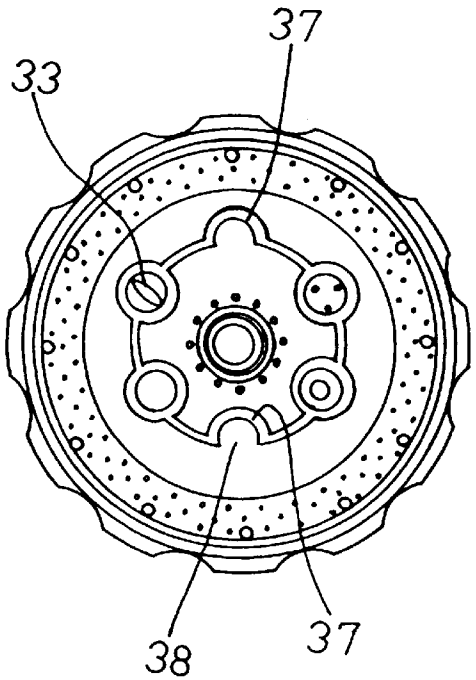
FIGS. 8A, 8B, 8C are diagrams shoving another embodiment of the present invention.
Figure 8B:
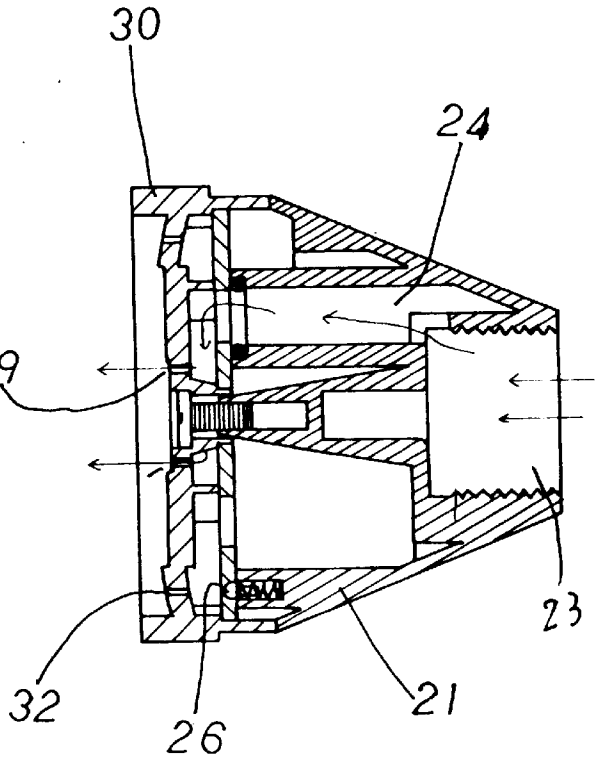
Figure 8A:
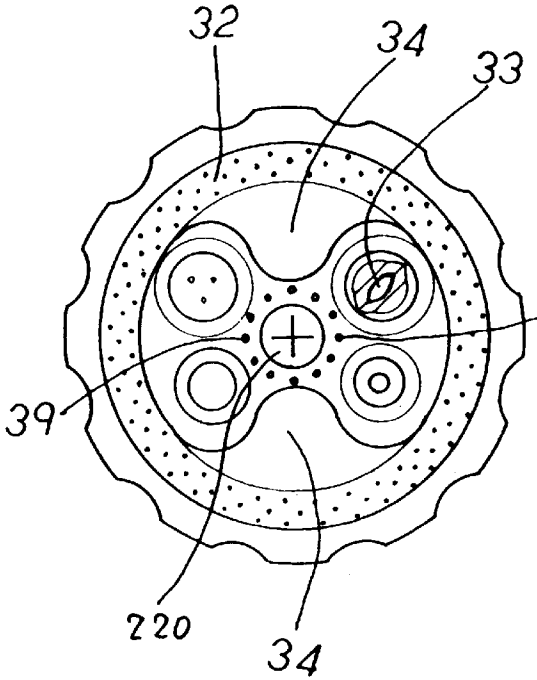

Referring to FIGS. 8A, 8B, 8C, a second embodiment of the present invention is illustrated wherein a circle of tiny pores 39 are disposed around the central mounting hole 300 with which the screw 220 is engaged. The cut 38 of the half tube 37 of the closed area 34 faces the inner side of the continually wall-closed area so that water can be discharged from the tiny pores 39 of the sprinkling cap 30 when the discharge outlet 24 of the base 21 comes into registration with the half tube 37, as shown in FIG. 8C.

I claim:

1. An improved sprinkler head for use on a sprinkler gun in connection to a garden hose, comprising a sprinkling cap, a bottom board and a base; said sprinkling cap and said bottom board being bound together by way of ultrasonic welding art; said base having a central mounting pole and a discharge outlet and a retaining seat that are linearly defined; a spring biased positioning pin being housed in said retaining seat; an O-shaped seal ring being engaged with said discharge outlet for sealing purpose; a ring area having a plurality of tiny pores being disposed adjacent the rim of said sprinkling cap with a number of discharge openings located along a circle inside said ring area; said bottom board having a number of through holes defined in correspondence to said discharge openings each having a tubular extension in registration with said through holes so as to make the bottom board and said sprinkling cap sealedly welded together; on one side of said bottom board facing said base being provided with a number of positioning cavities that are selectively engaged with said spring biased retaining pin mounted onto said base so as to lock said sprinkling cap in place when said sprinkling cap along with said bottom board being rotated to make one of said tubular extension come in registration with said discharge outlet;

the improvement being characterized in that said tubular extensions of said discharge openings of said sprinkling cap are bridged together by a continual wall so as to define a wall-closed area; said ring area having a plurality of tiny pores being located on the outer side of said wall-closed area and one of said tubular extensions being defined in a first half tube having a cut facing externally of said wall-closed area so that when said sprinkling cap being rotated to make said first half tube register with said discharge outlet of said base, water being discharged via said ring area having a plurality of tiny pores; a second half tube being formed among the rest of said tubular extensions with the cut thereof facing internally of said wall-closed area so that water being first delivered to the interior of said wall-closed area when said second half tube being registered with said discharge outlet and then discharged via a discharge opening located inside said second half tube, permitting water to be discharged with higher intensity.

2. The improved sprinkler head as claimed in claim 1 wherein said second half tube of said sprinkling cap is in communication with a vertically oriented narrow discharge opening so as to make water discharged with force and intensity.

3. The improved sprinkler head as claimed in claim 1 wherein a ring of tiny pores is disposed in the interior of said wall-closed area so as to permit water to be collected in the interior of said wall-closed area and then be discharged via said ring of tiny pores.

* * * * *